US005566516A

United States Patent [19]

Beaulieu

[11] Patent Number: 5,566,516

[45] Date of Patent: Oct. 22, 1996

[54] SPHERICAL GRID

[75] Inventor: Bryan J. Beaulieu, Burnsville, Minn.

[73] Assignee: Skyline Displays, Inc., Burnsville, Minn.

[21] Appl. No.: 237,740

[22] Filed: May 4, 1994

[51] Int. Cl.[6] ..... E04B 1/38

[52] U.S. Cl. ..... 52/81.3; 52/655.1; 52/DIG. 10; 403/171; 403/217

[58] Field of Search ..... 52/81.1–81.3, 52/655.1, DIG. 10; 403/171, 217

[56] References Cited

U.S. PATENT DOCUMENTS

| | | | |
|---|---|---|---|
| 2,682,235 | 6/1954 | Fuller . | |
| 4,353,662 | 10/1982 | DuChateau | 403/171 |
| 4,356,910 | 12/1982 | Ford | 52/81 BX |
| 4,669,909 | 6/1987 | Inchaurbe | 403/171 X |
| 5,048,995 | 9/1991 | Beaulieu . | |
| 5,088,245 | 2/1992 | Anderson | 52/81.3 X |
| 5,398,475 | 3/1995 | Kraus | 52/655.1 |

FOREIGN PATENT DOCUMENTS

| | | | |
|---|---|---|---|
| 0929862 | 6/1963 | United Kingdom | 52/83.1 |

*Primary Examiner*—Robert Canfield
*Attorney, Agent, or Firm*—Palmatier, Sjoquist & Helget, P.A.

[57] ABSTRACT

A spherical grid for constructing geodesic spheres and portions of spheres. The grid includes a plurality of links interconnecting with a plurality of hubs arranged in a geodesic configuration. The hubs have a cylindrical shape with top and bottom planar surfaces and five or six attachment positions equally spaced around the hub. Each attachment position has radially-extending holes equally spaced around the hub. The links have square recessed ends which engage with the hubs at each attachment position. An insert member affixed inside each end cooperates with a screw extending from inside the hub, through the hub into the recessed end to connect each end to the respective attachment position on the hub. Each recessed end of the links having an upper wall with an interior surface, a lower wall with an interior surface and sidewalls with vertical edges.

14 Claims, 5 Drawing Sheets

SPHERICAL GRID

BACKGROUND OF THE INVENTION

Geodesic spheres and domes have been utilized as a means of constructing spherical-shaped structures for many years. The structures may be of a total sphere or a smaller portion constituting a dome or half-shell type structure or other sphere portion. A basic configuration consists of a systemized network of structural members configured as equilateral triangles and arranged in a spherical pattern.

Typically the structures are assembled from multiple struts or links interconnected at hubs. The hubs are required to provide a joint with a high degree of rigidity to assure the integrity of the geodesic structure. Often the required rigidity is provided by relatively large and complicated hub assemblies which are not conducive to easy assembly, disassembly and portability.

SUMMARY OF THE INVENTION

A spherical grid for constructing geodesic spheres and portions of spheres is provided. The grid includes a plurality of links interconnecting with a plurality of hubs arranged in a geodesic configuration. The hubs have a cylindrical shape with five or six attachment positions equally spaced around the cylinder. Each attachment position has a radially-extending hole, and the holes are equally spaced around the cylinder. The links have square recessed ends which engage with the hubs at each attachment position. An insert member affixed inside each end cooperates with a screw extending from inside the hub, through the hub into the recessed end to connect each end to the respective attachment position on the hub. Each recessed end of the links has an upper wall with an interior surface, a lower wall with an interior surface and sidewalls with vertical edge surfaces.

When assembled, each hub fits between the interior surfaces to prevent axial movement and rotation of the link with respect to the hub. The vertical edge surfaces engage the circumferential surface of the hub to prevent angular movement of the link with respect to the hub axis, the screw prevents radial movement. In effect each recessed end of each link is locked into the attachment position on the respective hub. When the links and hubs are assembled in a grid with a geodesic configuration, an extremely strong and rigid structure results.

An advantage and feature of the invention is that the grid may be easily and inexpensively fabricated from readily available materials.

An advantage and feature of the invention is that assembly and disassembly may be quickly and easily accomplished resulting in a portable structure. The grid need not be totally disassembled for transport. That is, spherical sections may be left intact to speed assembly at the next location.

Another advantage and feature of the invention is that when totally disassembled the grid occupies relatively a minimal amount of space. The grid may be broken down into the links, the hubs, and screws to occupy a small fraction of the space occupied by the assembled grid.

Another advantage and feature of the invention is that the grid may be expanded or downsized for the specific application by simply adding or removing links and hubs.

DETAILED DESCRIPTION OF THE PREFERRED EMBODIMENTS

A spherical grid 20 and the cooperating elements comprising the same are shown in FIGS. 1–12. For the purposes of this description, it is understood that "vertical", "top", "bottom", "upper", and "lower" are merely illustrative of relative space positions of grid elements. The grid elements may be arranged in any orientation.

Figure 1:
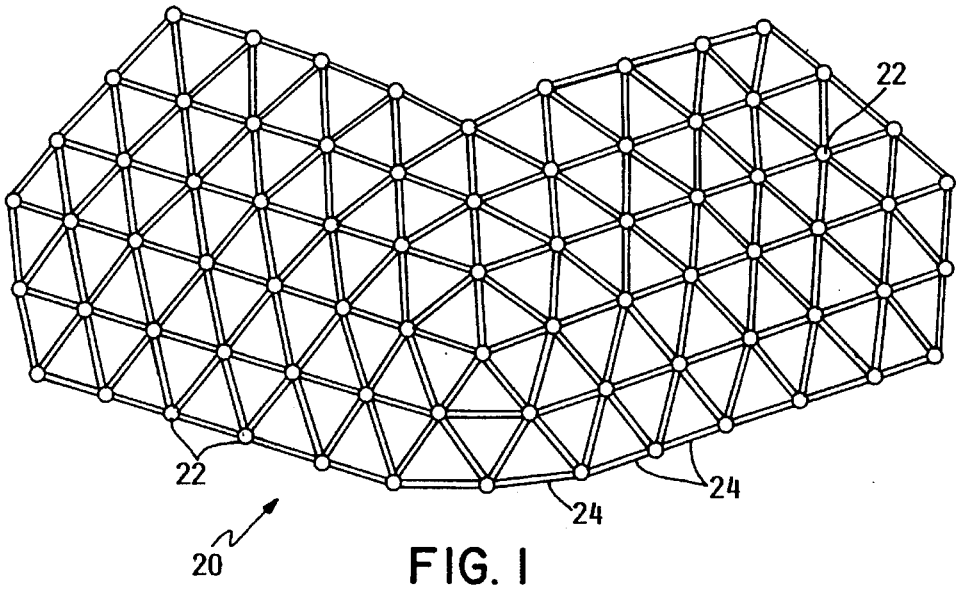
FIG. 1 shows a section of a spherical gridwork.
Figure 2:
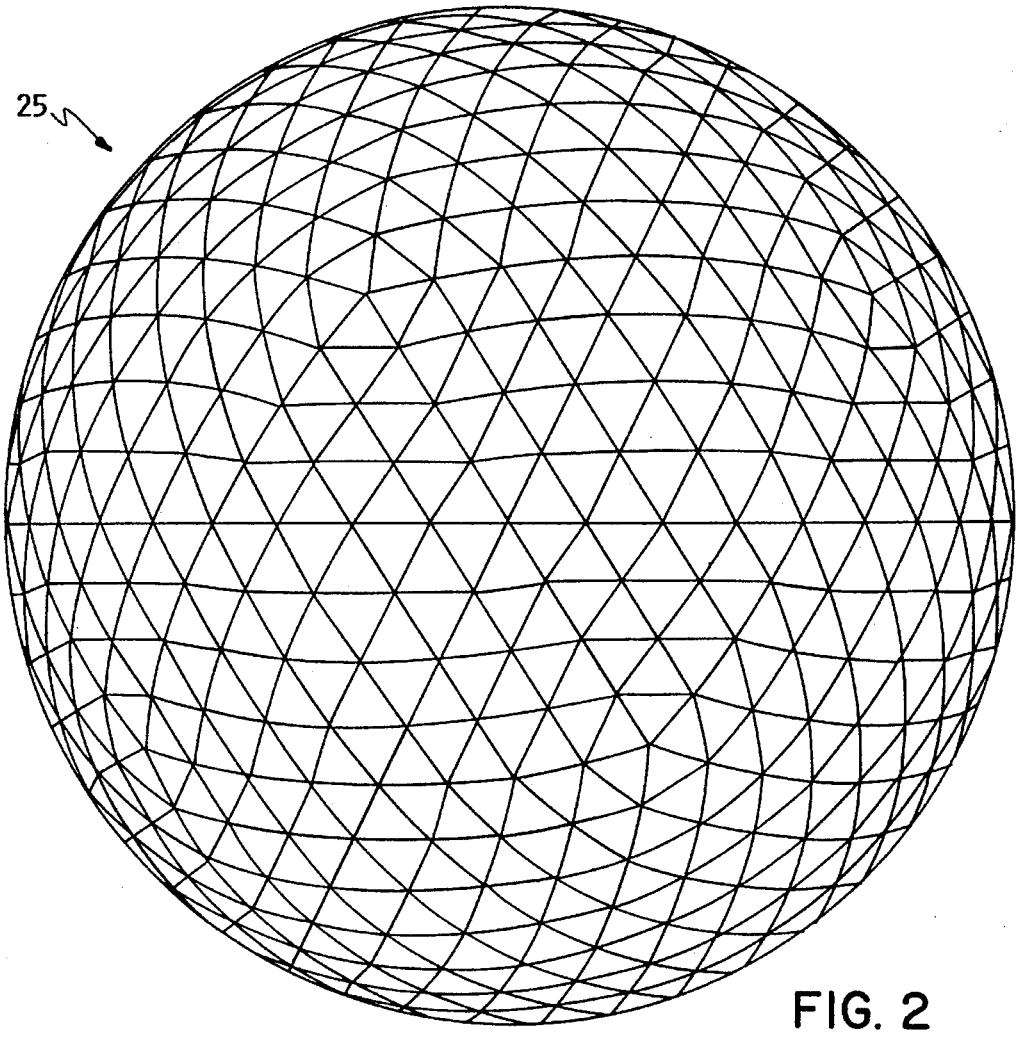
FIG. 2 shows a geodesic spherical grid.

FIG. 1 shows the spherical grid 20 comprised of a number of hubs 22 with interconnecting elongate links 24. The links 24 and hubs 22 cooperate to form a series of interconnecting triangles. The grid 20 as shown is a portion of a geodesic sphere, that is, a complete geodesic sphere 25 as illustrated in FIG. 2 could be assembled from the grid 20 shown with additional elongate links 24 and hubs 22. Note that the hubs 22 which are located within the grid 20, that is not on the edge of the grid 20, have either six or five elongate links 24 consistent with conventional design of geodesic domes. See U.S. Pat. No. 2,682,235 to R. B. Fuller, which is incorporated herein by reference, for a general description of geodesic structures and the placement of hubs with six links and hubs with five links.

Figure 3:
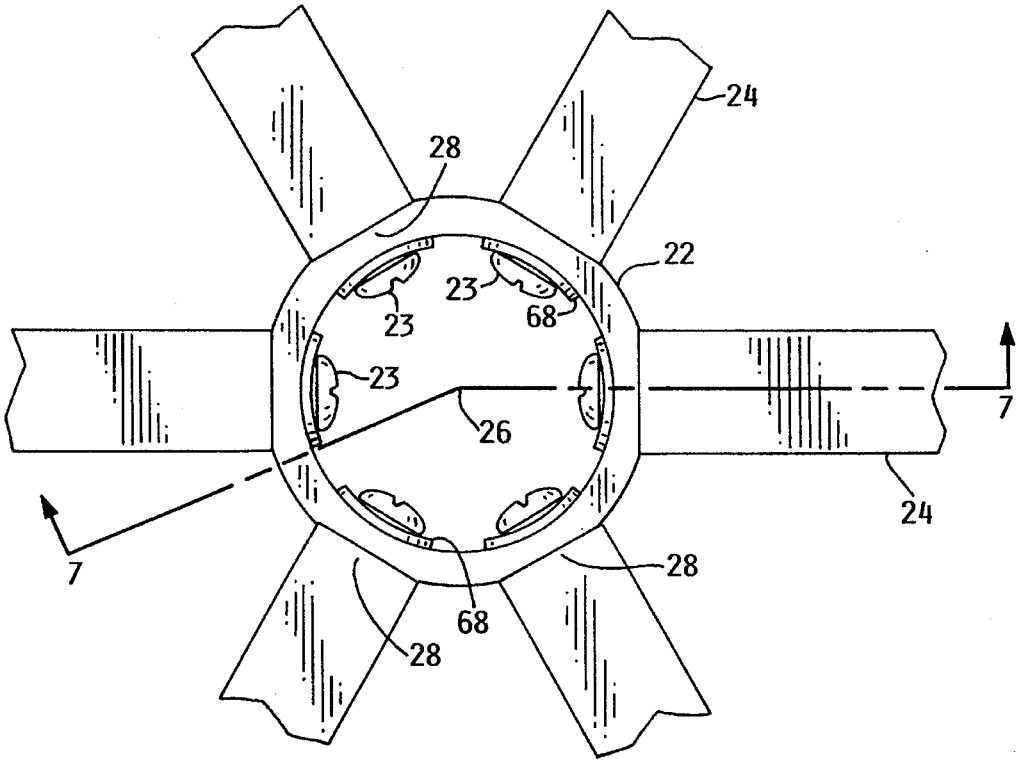
FIG. 3 depicts a plan view of a hub with connecting elongate links.
Figure 4:
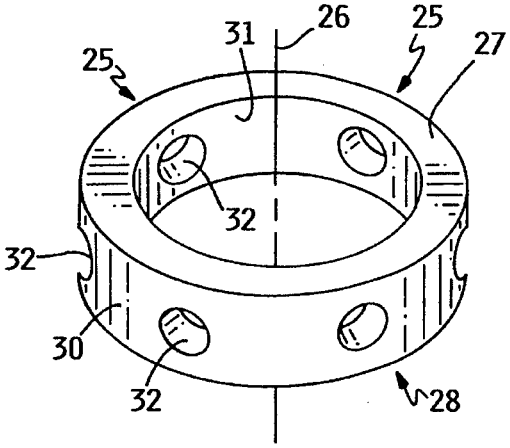
FIG. 4 shows an isometric view of a hub with six holes.
Figure 5:
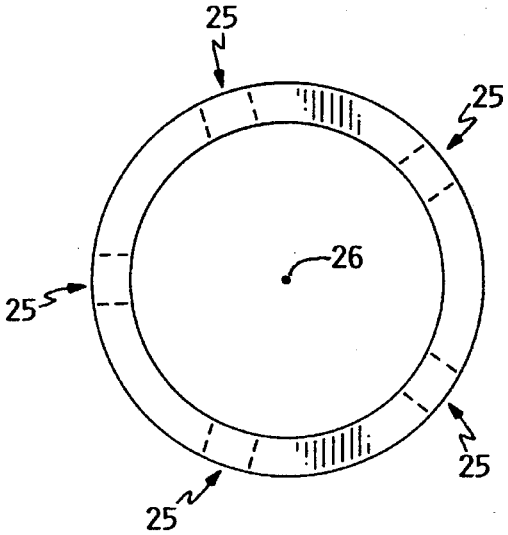
FIG. 5 shows a plan view of a hub with five attachment positions.

A detail of a hub 22 with six screws 23 and six elongate links 24 is shown in FIG. 3. The hub 22 is shown with a hub axis 26 from which the six elongate links 24 are aligned. Referring to FIGS. 3–5, each hub 22 has a total of five or six attachment positions 25 which correlate to the number of elongate links 24 attaching to the hub 22, at least insofar as when the hub 22 is located in interior of the grid 20. Where the grid 20 is not a total sphere, the attachment positions 25 for the hubs 22 on the edge of the grid 20 do not need to be utilized or may be otherwise utilized for attaching the grid 20 to some other appropriate support structure (not shown). Each hub 22 has a top surface 27, bottom surface 28, a circumferential surface 30, and an interior surface 31. Each attachment position 25 has a radially-directed hole 32.

Figure 6:
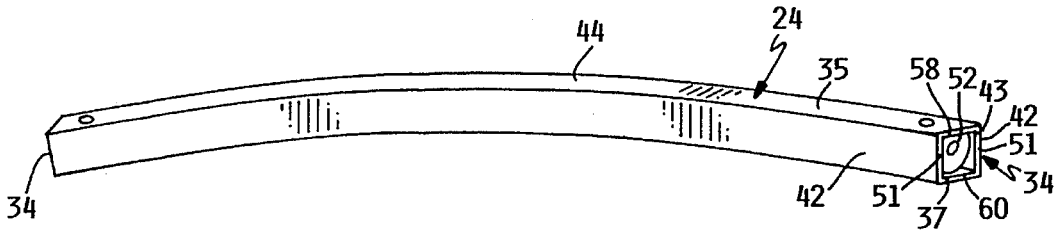
FIG. 6 shows an isometric view of an elongate link.
Figure 7:
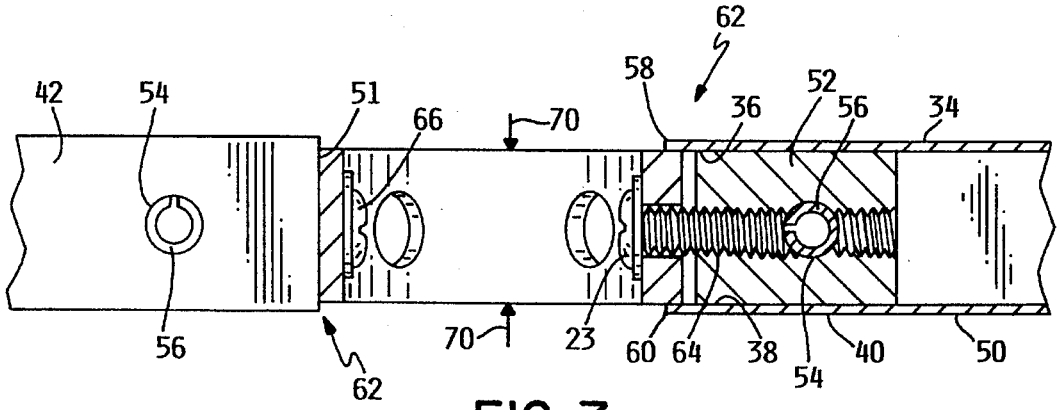
FIG. 7 shows a sectional taken along line 7—7 of FIG. 3.

FIGS. 6 and 7 show a drawing of an elongate link 24 which has two recessed ends 34 and, in the preferred embodiment, is comprised of square-shaped tubing. For a complete sphere there will be some variation in the individual required lengths of the links. See U.S. Pat. No. 2,682,235, R. B. Fuller. The square tubing may be composed of extruded aluminum stock which provides an ideal material in view of its strength and light weight. Alternatively the links may be made of other rigid materials such as steel.

Figure 8:
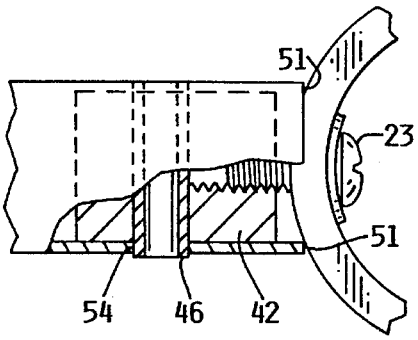
FIG. 8 shows a partial sectional plan view of the connection of an elongate link to a hub.

Each elongate link 24 has an upper wall 35, a lower wall 37, two sidewalls 42, an exterior top surface 44, an interior top surface 36, a lower interior surface 38, a lower exterior surface 50, and two vertical edge surfaces 51. In each end 34 is an insert member 52 fabricated of steel or aluminum and sized for a press fit within the elongate links 24. The insert member 52 is recessed within the end 34 of each elongate link 24 by suitable means such as welding or, as depicted in FIGS. 7 and 8, of a bore 54 extending through the sidewalls 42 and through the insert member 52 and with a spring pin 56 or other similar connecting means inserted in the bore 54. The upper wall 35 at the recessed end 34 forms an upper lip 58. Similarly, the lower wall 27 at the recessed end 34 forms a lower lip 60.

A preferred embodiment of an attachment means 62 securing the elongate links 24 to each attachment position 25 on the hubs 24 is best shown in FIGS. 7 and 8. The attachment means 62 comprises a threaded bore 64 extending axially through the insert member 52. Screws 66 are utilized in the preferred embodiment to extend through each hole 32 in each hub 22 to engage the threaded bore 64 and to fasten the hub 22 to each elongate link 24. A washer 68 may be utilized to distribute the loading of the screw 66 on the hub 22.

As shown best in FIGS. 7 and 8, the cylindrical hub 22 engages the elongate link 24 by way of fitting into the recessed end 34. The axial thickness of the hub 22, as indicated by arrows 70, is sized for the space between the interior upper surface 46 of the upper lip 58 and the interior lower surface 48 of the lower lip 60. The vertical edge surfaces 43 engage the circumferential surface 31.

As seen in FIGS. 1 and 2, not all the triangles are "perfect" equilateral triangles. The holes 32 may be slightly oversized to accommodate the slight variations resulting from this.

Figure 9:
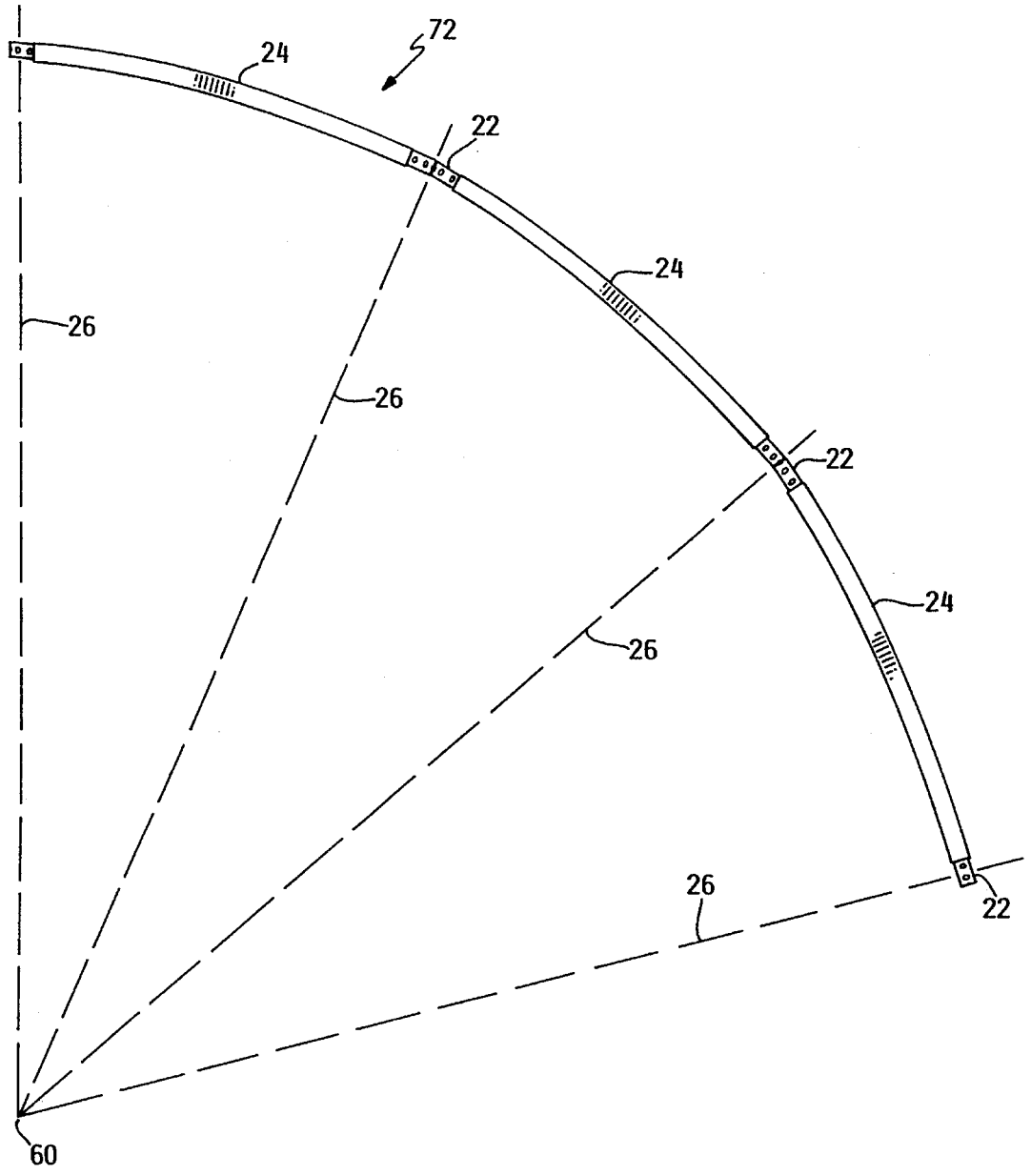
FIG. 9 is a plot of several hubs connected with elongate links depicting the hub axes aligned with the spherical center of curvature.

Referring to FIG. 9, three sequential elongate links 24 are shown with their ends 34 connected to four hubs 22. The hub axes 26 are shown converging at a spherical center point 60. In order to form the grid 20 into a spherical shape, a curvature means must be provided. One means of providing a curvature is shown in FIGS. 6 and 4 and is comprised of a curvature of the elongate link 24 such that the sidewalls 42 remain essentially planar, and parallel, and the top wall 35 and lower wall 39 are curved. As shown in FIG. 9, the curvature in the elongate links 24 function to align the hub axes 26 in the spherical grid 20 to the spherical center of curvature 60.

It should be understood that slight variations in the component parts and in assembly may result in a center of curvature larger than a single point.

Figure 10:
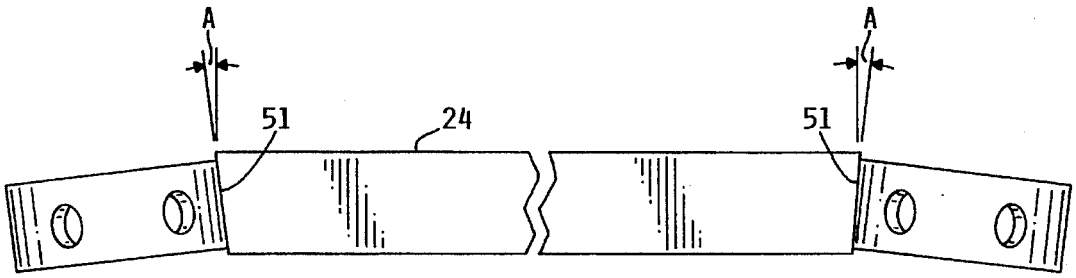
FIG. 10 shows an elevational view of an alternate embodiment of the invention.

FIG. 10 shows an alternative embodiment of the invention in which the curvature means is provided by edges 51 offset from perpendicular to the upper and lower walls 35, 37 by an angle A. In this embodiment the hubs 22 remain essentially the same with the exception that the radial holes 32 in the hubs 22 may be slightly angled from horizontal to match the offset of the edges 51.

Figure 11:
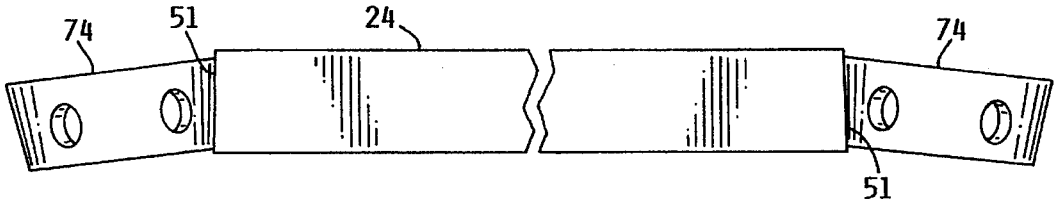
FIG. 11 shows an elevational view of an alternate embodiment of the invention.
Figure 12:
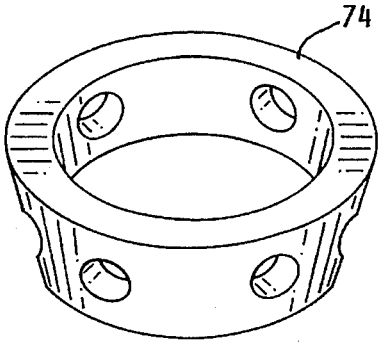
FIG. 12 shows an perspective view of a hub for the embodiment of the invention shown in FIG. 11.

FIG. 11 shows an alternative embodiment of the invention in which the curvature means is provided by frustoconical-shaped hubs 74. FIG. 12 shows a perspective of a frustoconical-shaped hub. It is apparent that a combination of the three curvature means may also be utilized to align the hub axis to the spherical center of the curvature 60.

Assembly of the spherical grid 20 is as follows. The ends of the elongate links 24 are engaged at the attachment positions on hubs 22 and the screws 23 with washers 68 are inserted and tightened. The screws 23 secure the hubs 22 into the recessed ends of the elongate links 24 between the upper lip 68 and lower lip 60. The insertion of the hubs 22 into the recessed ends 34 are limited by the engagement of the vertical edge surfaces 51 on the circumferential surface 30 of hubs 22. The engagement just described provides the connection between the hub and each end of each elongate link with substantial rigidity and strength and effect a locking effect to prevent lateral, axial, or angular movement at the connection.

For convenience and safety, assembly of a spherical structure may be accomplished totally at ground level. construction begins with the top of the spherical structure and proceeds downwardly on the structure as the structure is being raised. An extendible vertical tower (not shown) inside the grid 20 may be provided to raise the grid 20 as it is being assembled. Assembly in this manner alleviates the necessity of personnel working above ground level.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A spherical grid of a geodesic configuration, the grid having a spherical center of curvature and comprising:

a) a plurality of hubs, each hub having a hub axis, a planar top surface and a planar bottom surface parallel to said top surface, an open interior, an axial thickness separating the top and bottom surfaces, an exterior circumferential surface and a plurality of radial attachment positions, with a radially-extending hole at each attachment position;

b) a plurality of elongate rigid links, each link having two recessed rectangular ends, each end having an upper lip with an interior upper surface, a lower lip parallel with the upper lip and having an interior lower surface, two parallel vertical edges extending between the upper lip and the lower lip, the separation between the interior upper and lower surfaces sized to the axial thickness of the hub; and an insert member affixed within each end of each elongate link, each insert member having a threaded bore;

c) a plurality of attachment means for radially attaching each end of the elongate links to one of the attachment positions on one of the hubs whereby the links extend radially from the hubs, whereby the hubs are engaged within the recessed ends, and whereby the parallel vertical edges engage the exterior circumferential surface of the hubs; and wherein each attachment means comprises a threaded screw sized to cooperate with the threaded bore in an insert member, the screw being insertable through the radially-extending hole and being engageable with an insert member; and d) a curvature means for aligning each hub axis with the spherical center of curvature.

2. The grid of claim 1, wherein each hub is cylindrical and hollow.

3. The grid of claim 2, wherein the curvature means for aligning each hub axis with the spherical center of curvature comprises a curve in each elongate link.

4. The grid of claim 2, wherein each elongate link is straight and the means for aligning each hub axis with the spherical center of curvature is comprised of the two parallel edges being positioned at an angle with respect to the upper and lower lips.

5. The grid of claim 1, wherein the elongate links are straight and the curvature means is comprised of the hubs having a frustoconical shape.

6. A spherical grid of a geodesic configuration, the grid having a spherical center of curvature and comprised of:

a) a plurality of cylindrical and hollow hubs, each hub having a hub axis, a planar top surface and a planar bottom surface parallel with the top surface, an open interior, an axial thickness separating the top and bottom surfaces, an exterior circumferential surface and a plurality of equally spaced radial attachment positions, the number of radial attachment positions being at least five but not more than six;

b) a plurality of elongate rigid links, each link comprising hollow square tubing having an upper wall, a lower wall, and two sidewalls, and having two recessed square ends, each end having an upper lip integral with an upper wall, with an interior upper surface, a lower lip integral with a lower wall, parallel with the upper lip and having an interior lower surface, the separation between the interior surfaces sized to the axial thickness of the hub, two parallel vertical edges extending between the upper lip and the lower lip;

c) a plurality of attachment means for radially attaching each end of the elongate links to one of the attachment positions on one of the hubs whereby the links extend radially from the hubs, whereby the hubs are engaged within the recessed ends and whereby the parallel vertical edges engage the exterior circumferential surfaces of the hubs; and d) a curvature means for aligning each hub axis with the spherical center of curvature.

7. The grid of claim 6, wherein each hub has a radially extending hole at each attachment position, and wherein each attachment means comprises a threaded screw, an insert member affixed within the end of an elongate link, the insert member having a threaded bore sized to cooperate with the threaded screw, the screw inserted through the hole and engaged with the insert member.

8. The grid of claim 6, wherein the curvature means for aligning each hub axis with the spherical center of curvature comprises a curve in each elongate link.

9. The grid of claim 6, wherein the elongate links are straight and the curvature means is comprised of the hubs having a frustoconical shape.

10. The grid of claim 9, wherein each hub has a radially-extending hole at each attachment position, and wherein each attachment means comprises a threaded screw, an insert member affixed within the end of an elongate link, the insert member having a threaded bore sized to cooperate with the threaded screw, the screw inserted through the hole and engaged with the insert member.

11. The grid of claim 6, wherein each elongate link is straight and the means for aligning each hub axis with the spherical center of curvature is comprised of the vertical edges positioned at an oblique angle with respect to the elongate link.

12. The grid of claim 11, wherein each hub has a radially-extending hole at each attachment position, and wherein each attachment means comprises a threaded screw, an insert member affixed within the end of an elongate link, the insert member having a threaded bore sized to cooperate with the threaded screw, the screw inserted through the hole and engaged with the insert member.

13. A spherical grid of a geodesic configuration, the grid having a spherical center of curvature and comprised of:

a) a plurality of hollow cylindrical hubs, each hub having a hub axis, a planar top surface and a planar bottom surface parallel with the top surface, an axial thickness separating the top and bottom surfaces, an exterior circumferential surface and a plurality of equally spaced radial holes;

b) a plurality of square tubular elongate rigid links connecting adjacent hubs, each link having two recessed square ends, an upper wall, a lower wall and two sidewalls, each end having an upper lip integral with the upper wall, a lower lip integral with the lower wall, the distance between the upper lip and the lower lip sized to the axial thickness of the hub, the sidewalls having two parallel vertical edges extending between the upper lip and the lower lip;

c) each recessed end having an insert member affixed within the end, the insert member having a threaded bore;

d) a plurality of threaded screws sized to cooperate with the threaded bores, each screw inserted through the holes in the hubs and engaged in the threaded bore in the insert members of one of the recessed ends of the elongate links, and whereby the links extends radially from the hubs, whereby the hubs are engaged within the recessed ends, and whereby the two parallel edges confront and engage the exterior circumferential surfaces of the hub; and e) each elongate link having a curvature whereby each hub axis is aligned with the spherical center of curvature.

14. A spherical grid of a geodesic configuration, the grid having a spherical center of curvature and comprising:

a) a plurality of hubs, each hub having a hub axis, a planar top surface and a planar bottom surface parallel to said top surface, an open interior, an axial thickness separating the top and bottom surfaces, an exterior circumferential surface and a plurality of radial attachment positions;

b) a plurality of elongate rigid links, each link comprising hollow square tubing having an upper wall, a lower wall and two sidewalls; each link further comprising two recessed square ends, each end having an upper lip integral with the upper wall and having an interior upper surface, a lower lip integral with the lower wall and having an interior lower surface, and two parallel edges integral respectively with the sidewalls and extending between the upper lip and lower lip; the separation between the interior upper surface and the interior lower surface sized to the axial thickness of a hub;

c) a plurality of attachment means for radially attaching each end of an elongate link to one of the attachment positions on one of the hubs whereby the links extend radially from the hubs, whereby the hubs are engaged within the recessed ends, and whereby the parallel edges engage the exterior circumferential surface of a hub; and d) a curvature means for aligning each hub axis with the spherical center of curvature.

* * * * *